US007397337B2

(12) United States Patent
Hsu et al.

(10) Patent No.: US 7,397,337 B2
(45) Date of Patent: Jul. 8, 2008

(54) WINDING BASE STRUCTURE OF TRANSFORMER

(75) Inventors: Cheng-Chia Hsu, Chubei (TW); Yung-Chin Chou, Hsinchu County (TW)

(73) Assignee: Logah Technology Corp., Chupei, Hsinchu County (TW)

( * ) Notice: Subject to any disclaimer, the term of this patent is extended or adjusted under 35 U.S.C. 154(b) by 0 days.

(21) Appl. No.: 11/552,130

(22) Filed: Oct. 23, 2006

(65) Prior Publication Data

US 2008/0094163 A1 Apr. 24, 2008

(51) Int. Cl.
*H01F 27/30* (2006.01)

(52) U.S. Cl. ..... 336/208; 336/198

(58) Field of Classification Search ..... 336/208, 336/198, 192, 180, 182
See application file for complete search history.

(56) References Cited

U.S. PATENT DOCUMENTS 4,250,479 A * 2/1981 Bausch et al. ..... 336/208
7,034,648 B2 * 4/2006 Shirahata et al. ..... 336/220
7,106,160 B2 * 9/2006 Tsergas et al. ..... 336/192
7,183,889 B2 * 2/2007 Fushimi ..... 336/208

* cited by examiner

*Primary Examiner*—Anh T Mai
(74) *Attorney, Agent, or Firm*—Pai Patent and Trademark Law Firm; Chao-Chang Daivd Pai

(57) ABSTRACT

An improved winding base structure of a transformer is assembled by combining a primary-side winding base and a secondary-side winding base. The selection of the material of the primary-side winding base and the secondary-side winding base is dependant on the compression-resistant capability because the primary-side input and the secondary-side output of the transformer bear different voltages. The outside of the assembled winding base is disposed with grooves in which the wires are wound, and the center of the winding base is disposed with a through hole for an iron core to be put therein to form a transformer. The sectional winding base of the subject application is characterized in that the primary-side winding base is made of lower compression-resistant material and the secondary-side winding base is made of higher compression-resistant material. Therefore the production cost of the winding base is reduced.

13 Claims, 7 Drawing Sheets

WINDING BASE STRUCTURE OF TRANSFORMER

BACKGROUND OF THE INVENTION

1. Field of the Invention

The present invention relates to an improved winding base structure of a transformer and more particularly to a desired sectional winding base that is made of two parts of low or high compression-resistant material to reduce the production cost.

2. Description of the Prior Art

FIGS. 1 and 2 are side-view diagrams of the winding base structures of the conventional transformer. The winding base structures 1 and 2 are used to illustrate different types of transformers and are made in a one-piece manner. The outside of the conventional transformer is disposed with a plurality of grooves 111, 121, 211 and 221 such that the winding base structures 1 and 2 are divided into a primary-side input 11, 21 and a secondary-side output 12, 22. Nonetheless, the primary-side input 11, 21 and the secondary-side output 12, 22 of the conventional transformer bear different voltages. Because the winding base structures 1 and 2 are made in a one-piece manner, the manufacturers use a higher compression-resistant material to make both the primary-side input 11, 21 and the secondary-side output 12, 22 so that the secondary-side output 12, 22 of the winding base can bear the higher voltage. Although the winding base structures 1 and 2 can bear higher voltage, however, the cost of the material is relatively increased and therefore troubles the manufacturer.

In view of the above, the conventional products are not well designed and still have lots of defects.

The inventor is aware of the defects in the conventional products and concentrates his attention in improving the products by long-term research and practice so that the subject improved winding base structure of a transformer is finally accomplished.

SUMMARY OF THE INVENTION

One object of the subject application is to provide an improved winding base structure of a transformer assembled by combining two winding bases such that the two winding bases can be made of a higher compression-resistant material or a lower compression-resistant material to bear different voltages, thereby reducing the production cost of the winding base.

Another object of the subject application is to provide an improved winding base structure of a transformer with unsophisticated structure that can be easily manufactured at low cost.

An improved winding base structure of a transformer comprises a primary-side winding base and a secondary-side winding base. The outside of the assembled winding base is disposed with grooves and the wires are wound in the grooves, and the center of each winding base is disposed with a through hole for an iron core to be put therein to form a transformer. The sectional winding base of the subject application is characterized in that the primary-side winding base is made of lower compression-resistant material and the secondary-side winding base is made of higher compression-resistant material instead of having higher compression-resistant material used in both the primary-side and the secondary-side winding bases of the conventional transformer. Therefore the production cost of the winding base is reduced.

The features and advantages of the present invention will be fully understood and appreciated from the following detailed description of the accompanying Drawings.

DETAILED DESCRIPTION OF THE PREFERRED EMBODIMENT

Figure 1:
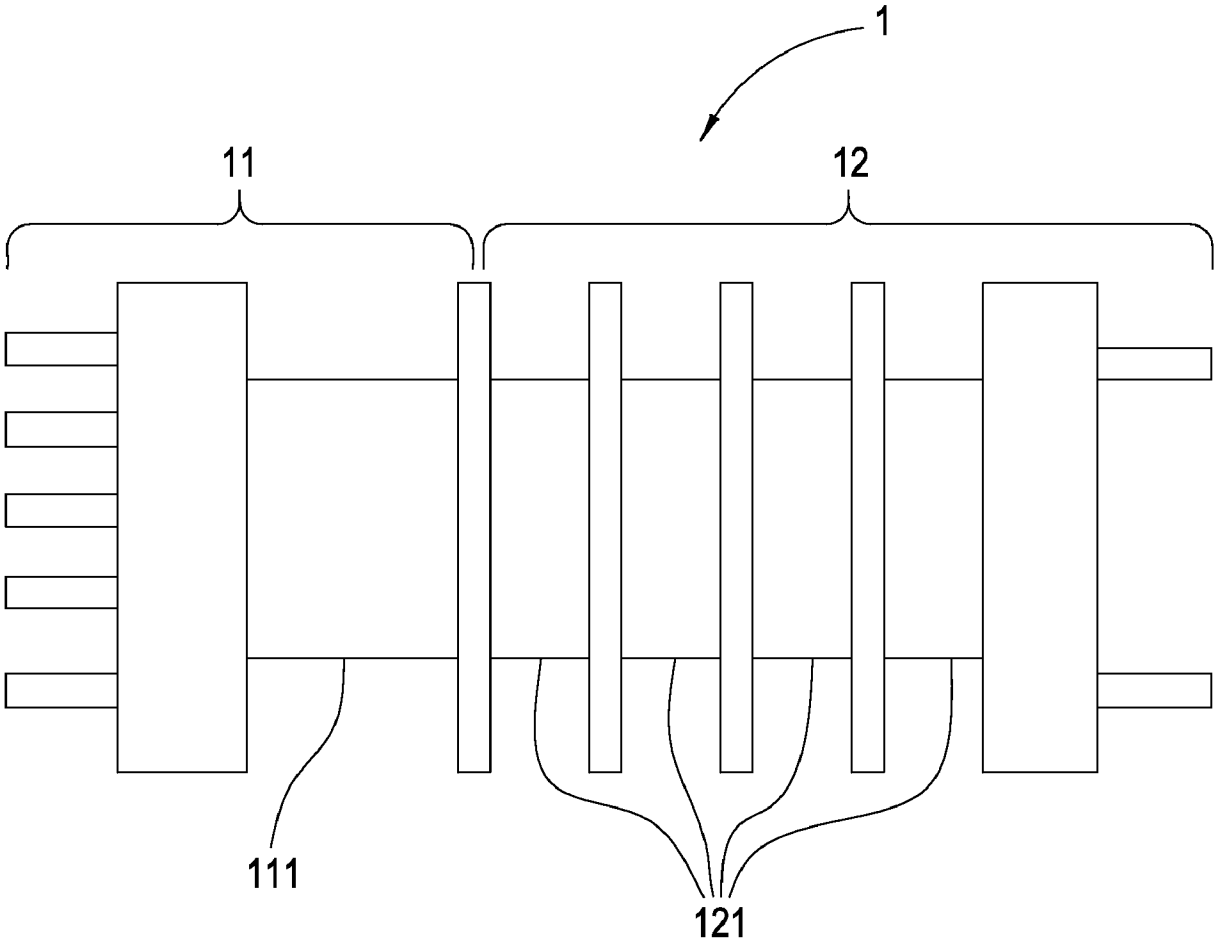
PRIOR ART FIG. 1
FIGS. 1 and 2 are side views of the winding bases of the conventional transformers.
Figure 2:
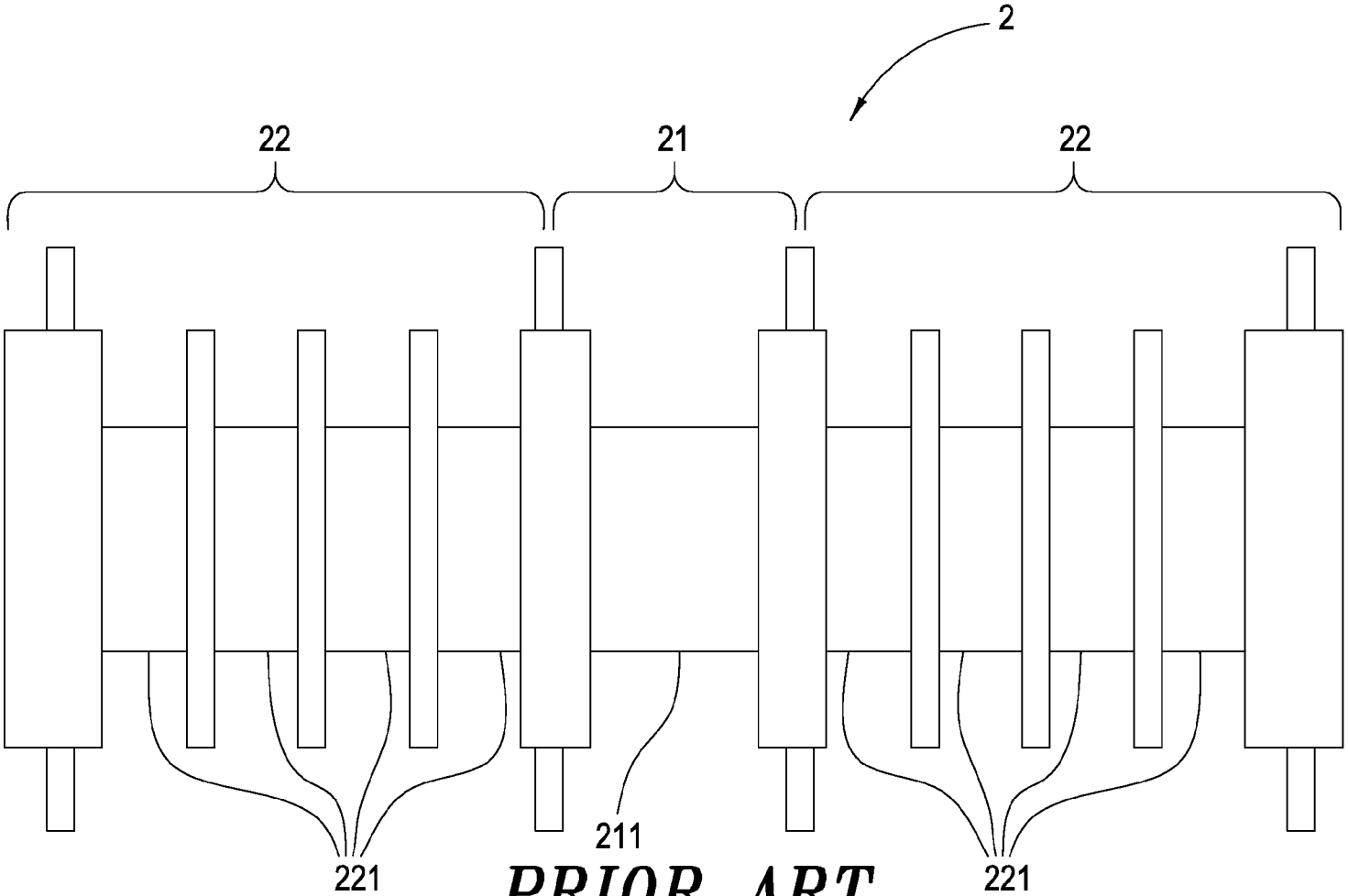
PRIOR ART FIG.2
Figure 3:
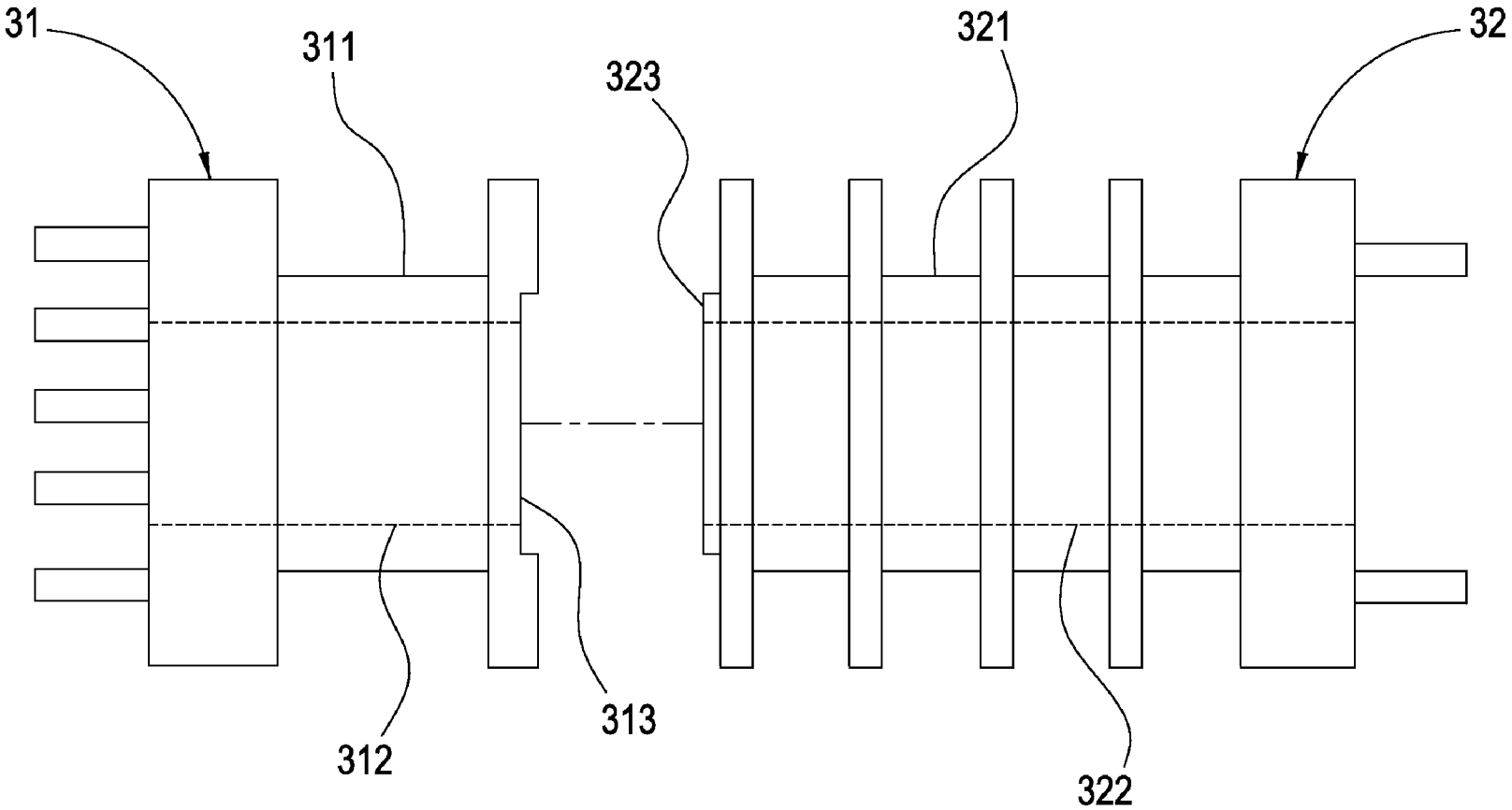
FIG. 3 is a side-view of the first embodiment of an improved winding base structure of a transformer of the present invention.

Referring to FIG. 3, which shows a side-view of the first embodiment of the improved winding base structure of a transformer provided by the present invention, the improved winding base structure of a transformer mainly comprises:

a primary-side winding base 31, wherein the outside of the primary-side winding base 31 is disposed with a plurality of grooves 311; a through hole 312 is set in the center of the primary-side winding base 31; the inside of the primary-side winding base 31 is formed with a recess 313; the primary-side winding base 31 is made of a lower compression-resistant material; and the wires can be wound in the grooves 311; and a secondary-side winding base 32, wherein the outside of the secondary-side winding base 32 is disposed with a plurality of grooves 321; a through hole 322 is set in the center of the secondary-side winding base 32; the inside of the secondary-side winding base 32 is formed with a protrusion 323 corresponding to the recess 313 of the primary-side winding base 31; the secondary-side winding base 32 uses the protrusion 323 to combine with the recess 313 of the primary-side winding base 31; the protrusion 323 and the recess 313 are engaged with or adhered to each other; the secondary-side winding base 32 is made of a higher compression-resistant material; and the wires can be wound in the grooves 321.

Figure 4:
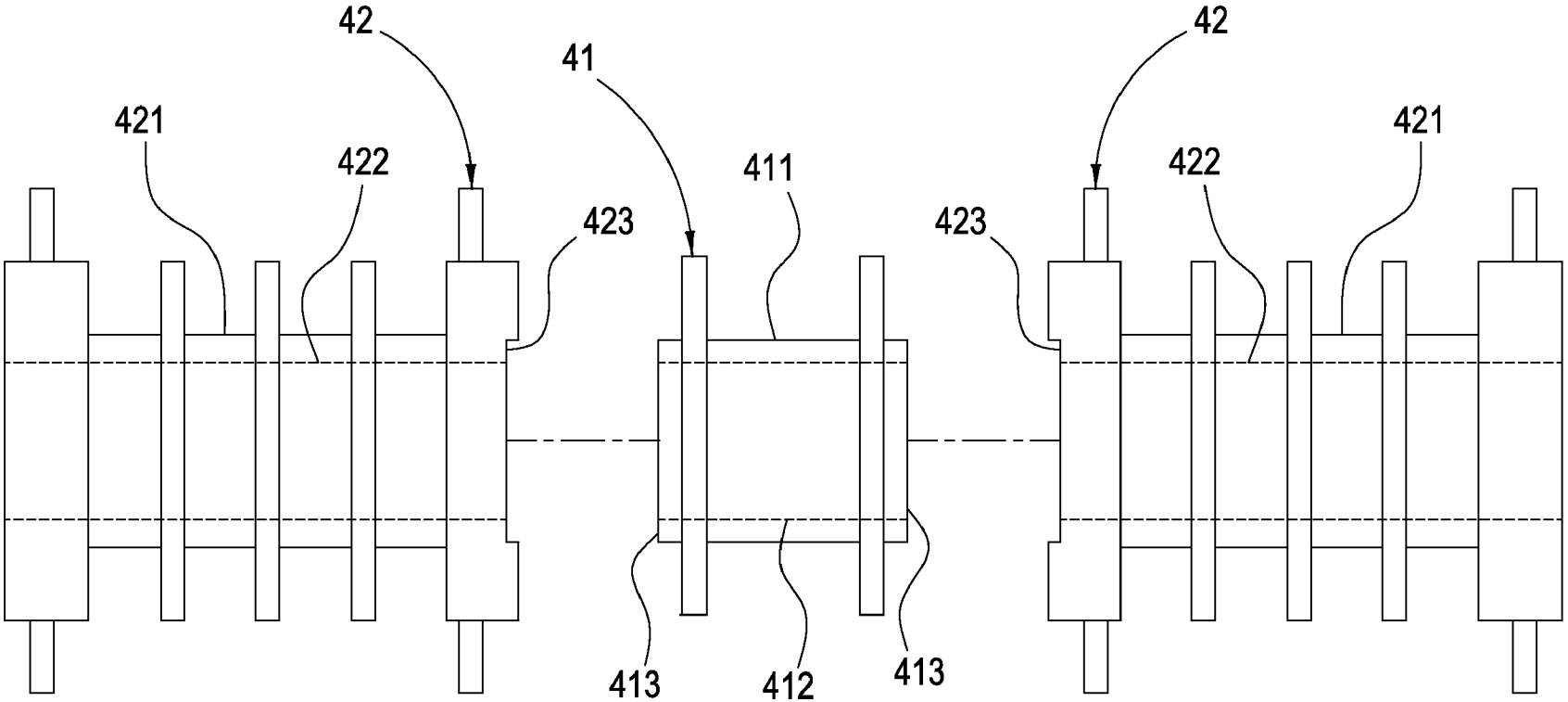
FIG. 4 is a side-view of the second embodiment of an improved winding base structure of a transformer of the present invention.

Referring to FIG. 4, which shows a side-view of the second embodiment of the improved winding base structure of a transformer provided by the present invention, the improved winding base structure of a transformer mainly comprises:

a primary-side winding base 41, wherein the outside of the primary-side winding base 41 is disposed with a plurality of grooves 411; a through hole 412 is set in the center of the primary-side winding base 41; a protrusion 413 is disposed on each of two ends of the primary-side winding base 41; the primary-side winding base 41 is made of a lower compression-resistant material; and the wires can be wound in the grooves 411; and at least two secondary-side winding bases 42, wherein the outside of the secondary-side winding base 42 is disposed with a plurality of grooves 421; a through hole 422 is set in the center of the secondary-side winding base 42; the inside of the secondary-side winding base 42 is formed with a recess 423 corresponding to the protrusion 413 of the primary-side winding base 41; the secondary-side winding base 42 uses the recess 423 to combine with the protrusion 413 on two ends of the primary-side winding base 41; the protrusion 413 and the recess 423 are engaged with or adhered to each other; the secondary-side winding base 42 is made of a higher compression-resistant material; and the wires can be wound in the grooves 421.

Figure 5:
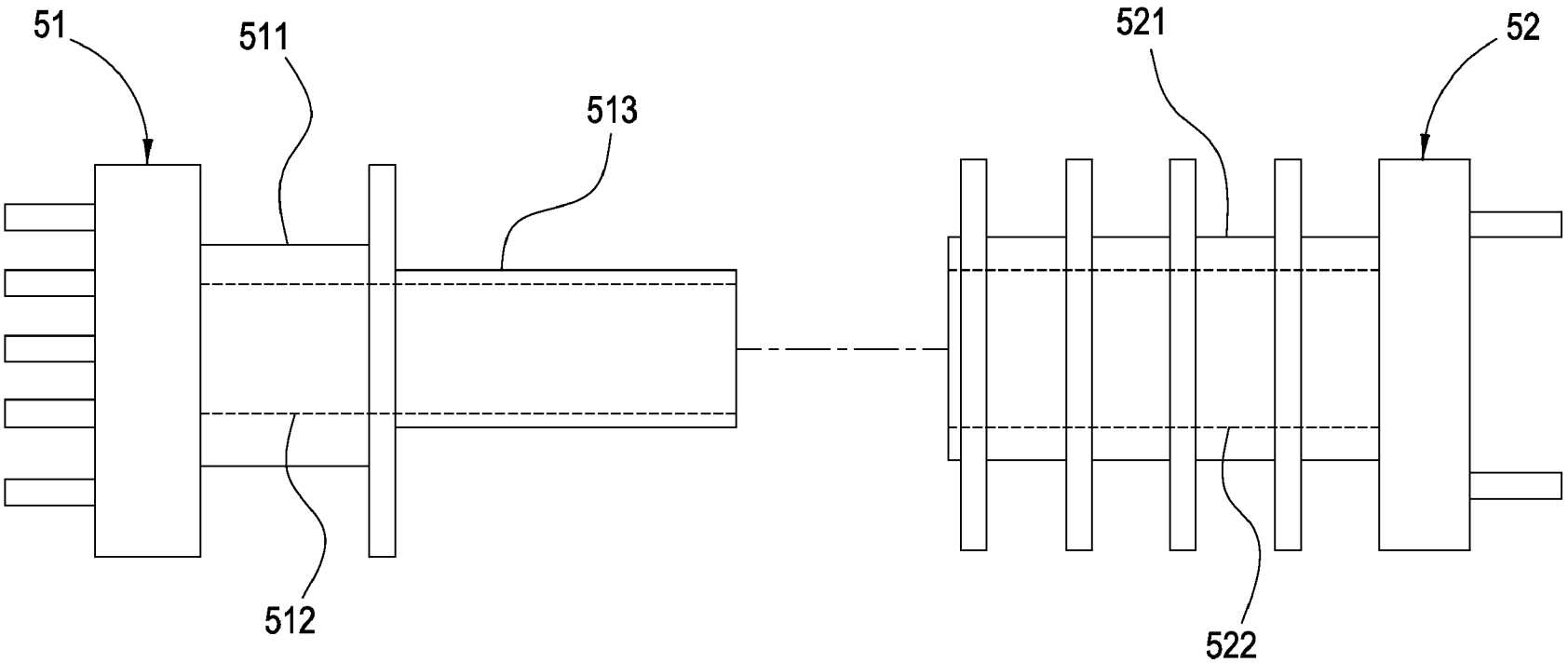
FIG. 5 is a side-view of the third embodiment of an improved winding base structure of a transformer of the present invention.

Referring to FIG. 5, which shows a side-view of the third embodiment of the improved winding base structure of a transformer provided by the present invention, the improved winding base structure of a transformer mainly comprises:

a primary-side winding base 51, wherein the outside of the primary-side winding base 51 is disposed with a plurality of grooves 511; a through hole 512 is set in the center of the primary-side winding base 51; the inside of the primary-side winding base 51 outwardly extends with an insertion 513; the primary-side winding base 51 is made of a lower compression-resistant material; and the wires can be wound in the grooves 511; and a secondary-side winding base 52, wherein the outside of the secondary-side winding base 52 is disposed with a plurality of grooves 521; a through hole 522 is set in the center of the secondary-side winding base 52 corresponding to the insertion 513 of the primary-side winding base 51; the through hole 522 of the secondary-side winding base 52 is combined with the insertion 513 of the primary-side winding base 51; the secondary-side winding base 52 is made of a higher compression-resistant material; and the wires can be wound in the grooves 521.

Figure 6:
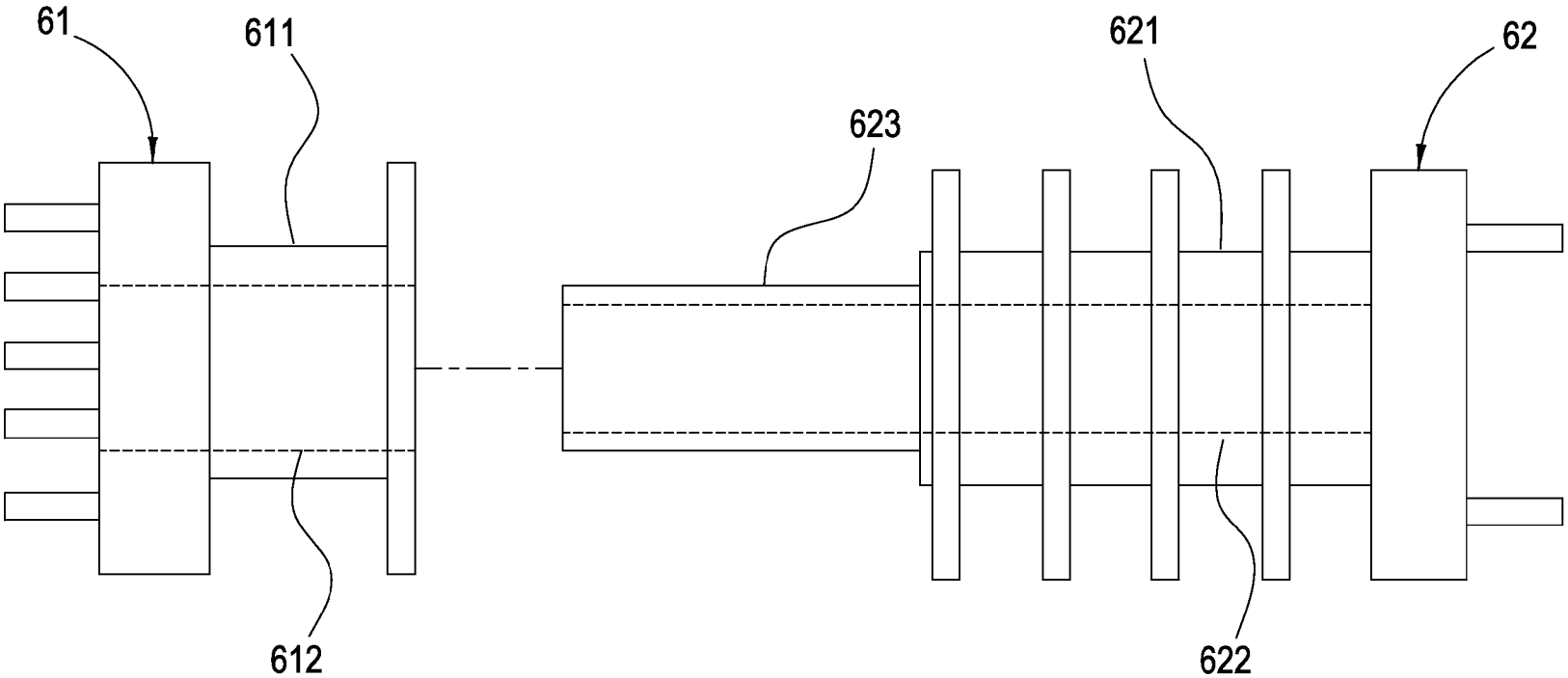
FIG. 6 is a side-view of the fourth embodiment of an improved winding base structure of a transformer of the present invention.

Referring to FIG. 6, which shows a side-view of the fourth embodiment of the improved winding base structure of a transformer provided by the present invention, the improved winding base structure of a transformer mainly comprises:

a primary-side winding base 61, wherein the outside of the primary-side winding base 61 is disposed with a plurality of grooves 611; a through hole 612 is set in the center of the primary-side winding base 61; the primary-side winding base 61 is made of a lower compression-resistant material; and the wires can be wound in the grooves 611; and two secondary-side winding bases 62, wherein the outside of each secondary-side winding base 62 is disposed with a plurality of grooves 621; a through hole 622 is set in the center of the secondary-side winding base 62; the inside of the secondary-side winding base 62 outwardly extends with an insertion 623 corresponding to the through hole 612 of the primary-side winding base 61; the insertion 623 of the secondary-side winding base 62 is combined with the through hole 611 of the primary-side winding base 61; the secondary-side winding base 62 is made of a higher compression-resistant material; and the wires can be wound in the grooves 621.

Figure 7:
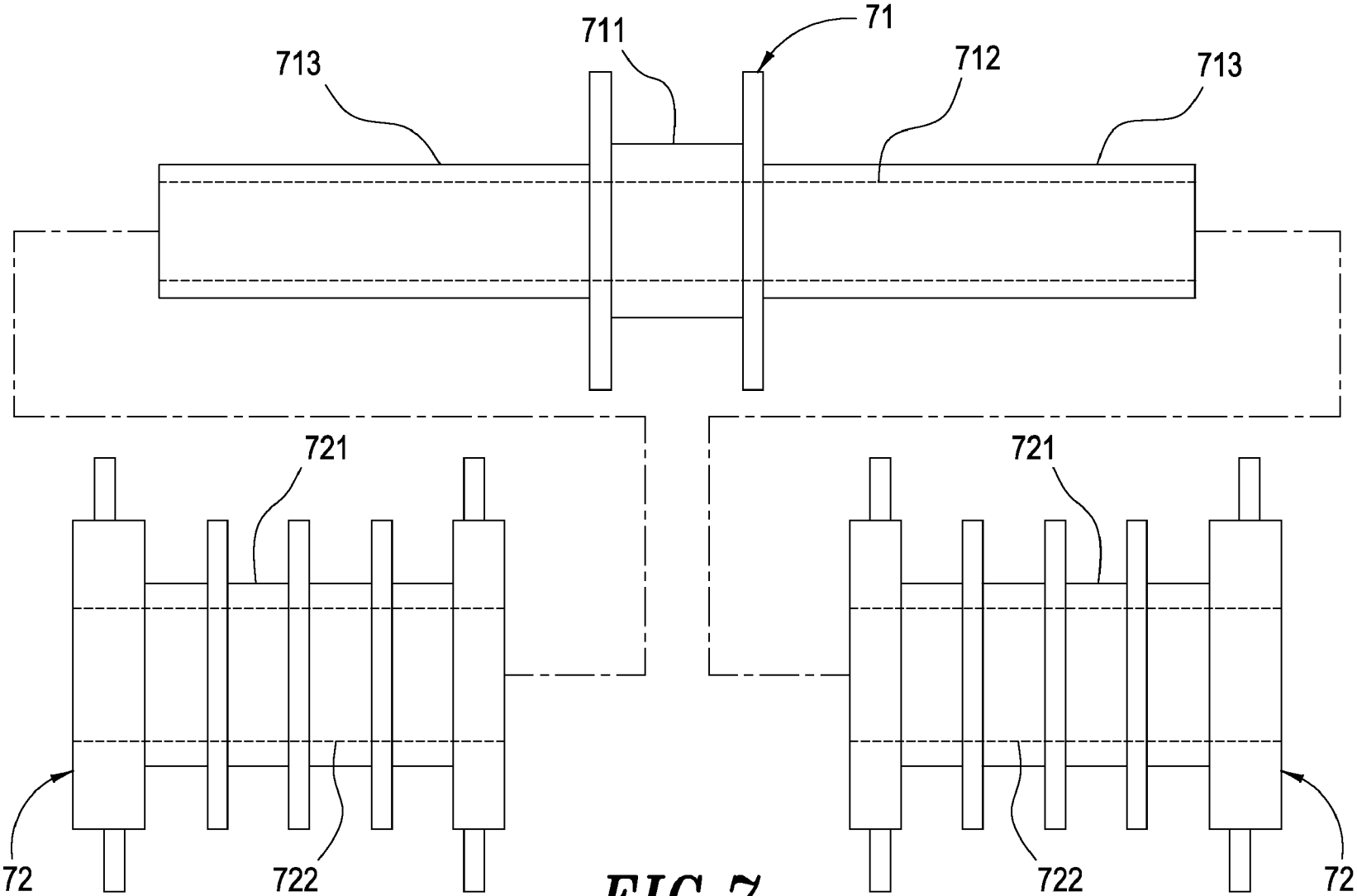
FIG. 7 is a side-view of the fifth embodiment of an improved winding base structure of a transformer of the present invention.

Referring to FIG. 7, which shows a side-view of the fifth embodiment of the improved winding base structure of a transformer provided by the present invention, the improved winding base structure of a transformer mainly comprises:

a primary-side winding base 71, wherein the outside of the primary-side winding base 71 is disposed with a plurality of grooves 711; a through hole 712 is set in the center of the primary-side winding base 71; two ends of the primary-side winding base 71 outwardly extend with an insertion 713; the primary-side winding base 71 is made of a lower compression-resistant material; and the wires can be wound in the grooves 711; and at least two secondary-side winding bases 72, wherein the outside of the secondary-side winding base 72 is disposed with a plurality of grooves 721; a through hole 722 is set in the center of the secondary-side winding base 72 corresponding to one of the insertions 713 of the primary-side winding base 71; the through hole 722 of the secondary-side winding base 72 combines with the insertion 713 at either end of the primary-side winding base 71; the secondary-side winding base 72 is made of a higher compression-resistant material; and the wires can be wound in the grooves 721.

The sectional winding base of the present invention is made of different material suitable for each part of the sectional winding base to bear different voltages, as compared to the conventional winding base that is totally made of a higher compression-resistant material. Therefore, the present invention reduces the production cost of the winding base.

The improved winding base structure of a transformer has the following advantages in view of the conventional technology:

1. The sectional winding base of the present invention is made of a higher compression-resistant or lower compression-resistant material suitable for each part of the sectional winding base to bear different voltages such that the production cost of the winding base is reduced.

2. The present invention provides an improved winding base structure of a transformer with unsophisticated structure that can be easily manufactured at low cost.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An improved winding base structure of a transformer comprising:

a primary-side winding base on which a plurality of grooves is disposed, a through hole being set in the center of the primary-side winding base; and a secondary-side winding base on which a plurality of grooves is disposed, a through hole being set in the center of the secondary-side winding base;

characterized in that:

the primary-side winding base and the secondary-side winding base are separately formed;

the grooves of the primary-side winding base and the grooves of the secondary-side winding base are respectively wound with windings of different materials, and the primary-side winding base and the secondary-side winding base are assembled by putting an iron core through the through holes of the primary-side and secondary-side winding bases to form the transformer.

2. The improved winding base structure of a transformer of claim 1, wherein the primary-side winding base is made of a lower compression-resistant material.

3. The improved winding base structure of a transformer of claim 1, wherein the secondary-side winding base is made of a higher compression-resistant material.

4. The improved winding base structure of a transformer of claim 1, wherein an inside of the primary-side winding base is disposed with a recess and an inside of the secondary-side winding base is disposed with a protrusion such that the primary-side winding base and the secondary-side winding base are assembled further by the combination of the recess and the protrusion.

5. The improved winding base structure of a transformer of claim 4, wherein the recess and the protrusion are engaged with or adhered to each other.

6. The improved winding base structure of a transformer of claim 1, wherein an inside of the primary-side winding base outwardly extends with an insertion, which has a dimension substantially corresponding to the through hole of the secondary-side winding base, such that the primary-side winding base and the secondary-side winding base are assembled further by inserting the insertion into the through hole of the secondary-side winding base.

7. The improved winding base structure of a transformer of claim 1, wherein an inside of the secondary-side winding base outwardly extends with an insertion, which has a dimension substantially corresponding to the through hole of the primary-side winding base, such that the primary-side winding base and the secondary-side winding base are assembled further by inserting the insertion into the through hole of the primary-side winding base.

8. An improved winding base structure of a transformer comprising:

a primary-side winding base on which a plurality of grooves is disposed, a through hole being set in the center of the primary-side winding base; and at least two secondary-side winding bases on each of which a plurality of grooves is disposed, a through hole being set in the center of the secondary-side winding base;

characterized in that:

the grooves of the primary-side winding base and the grooves of the secondary-side winding base are respectively wound with windings of different materials, and the primary-side winding base and the secondary-side winding base are assembled by putting an iron core through the through holes of the primary-side and secondary-side winding bases to form the transformer.

9. The improved winding base structure of a transformer of claim 8, wherein the primary-side winding base is made of a lower compression-resistant material.

10. The improved winding base structure of a transformer of claim 8, wherein the secondary-side winding base is made of a higher compression-resistant material.

11. The improved winding base structure of a transformer of claim 8, wherein each of two ends of the primary-side winding base is disposed with a protrusion and an inside of each of the secondary-side winding bases is disposed with a recess such that the primary-side winding base and the secondary-side winding bases are assembled further by the combination of the recesses and the protrusions.

12. The improved winding base structure of a transformer of claim 11, wherein the recesses and the protrusions are engaged with or adhered to each other.

13. The improved winding base structure of a transformer of claim 8, wherein each of two ends of the primary-side winding base respectively and outwardly extends with an insertion, which has a dimension substantially corresponding to the through hole of a respective one of the secondary-side winding bases, such that the primary-side winding base and the secondary-side winding bases are assembled further by respectively inserting the insertions into the through hole of the secondary-side winding bases.

* * * * *